US005627802A

United States Patent [19]

Langer

[11] Patent Number: 5,627,802

[45] Date of Patent: May 6, 1997

[54] SOUND AMPLIFICATION SYSTEM HAVING A SUBMERSIBLE MICROPHONE

[75] Inventor: Alexander G. Langer, Cudjoe Key, Fla.

[73] Assignee: Langer Electronics Corp., Cudjoe Key, Fla.

[21] Appl. No.: 543,509

[22] Filed: Oct. 16, 1995

Related U.S. Application Data

[63] Continuation-in-part of Ser. No. 492,412, Jun. 19, 1995, abandoned.

[51] Int. Cl.[6] ..... H04R 17/00; H04R 1/44

[52] U.S. Cl. ..... 367/188

[58] Field of Search ..... 367/141, 165, 367/173, 188; 43/17.1, 43.12; 310/337, 334

[56] References Cited

U.S. PATENT DOCUMENTS

| | | | |
|---|---|---|---|
| 3,103,559 | 9/1963 | Ward . | |
| 3,136,854 | 6/1964 | Willick . | |
| 3,224,405 | 12/1965 | Fergusson et al. . | |
| 3,711,821 | 1/1973 | Dale et al. . | |
| 3,789,353 | 1/1974 | Hunter et al. . | |
| 3,793,623 | 2/1974 | Gongwer . | |
| 3,855,571 | 12/1974 | Massa . | |
| 3,878,502 | 4/1975 | Rochelle . | |
| 3,885,338 | 5/1975 | York | 43/17.1 |
| 3,983,483 | 9/1976 | Pando | 325/16 |
| 3,990,035 | 11/1976 | Byers . | |
| 4,167,830 | 9/1979 | Ogawa | 46/17 |
| 4,173,195 | 11/1979 | Gongwer | 114/244 |
| 4,186,370 | 1/1980 | Cupolo et al. | 367/130 |
| 4,245,651 | 1/1981 | Frost | 128/721 |
| 4,272,835 | 6/1981 | Flood et al. | 367/4 |
| 4,324,135 | 4/1982 | Peyton | 73/187 |
| 4,494,938 | 1/1985 | Flood et al. | 441/33 |
| 4,539,560 | 9/1985 | Fleck et al. | 340/573 |
| 4,673,363 | 6/1987 | Hudson et al. | 441/1 |
| 4,695,988 | 9/1987 | Banno | 367/154 |
| 4,733,378 | 3/1988 | Pearce et al. | 367/17 |
| 4,930,243 | 6/1990 | Lowe et al. | 43/17 |
| 4,954,110 | 9/1990 | Warnan | 441/22 |
| 4,974,213 | 11/1990 | Siwecki | 367/88 |
| 4,980,926 | 12/1990 | Noetzel | 455/617 |
| 4,992,999 | 2/1991 | Yerby et al. | 367/130 |
| 5,022,012 | 6/1991 | Godfrey et al. | 367/3 |
| 5,033,032 | 7/1991 | Houghtaling | 367/160 |
| 5,136,549 | 8/1992 | Berglund | 367/20 |
| 5,136,555 | 8/1992 | Gardos | 367/132 |
| 5,142,503 | 8/1992 | Wilcox et al. | 367/88 |
| 5,155,707 | 10/1992 | Fisher | 367/149 |
| 5,251,326 | 10/1993 | Silverman | 455/40 |
| 5,253,220 | 10/1993 | Wilson, Jr. | 367/17.1 |
| 5,277,179 | 1/1994 | Stone et al. | 128/201.19 |
| 5,282,178 | 1/1994 | Hill et al. | 367/141 |
| 5,365,595 | 11/1994 | Li | 381/168 |
| 5,367,296 | 11/1994 | Schell | 340/984 |
| 5,381,382 | 1/1995 | Marschall | 367/20 |
| 5,417,008 | 5/1995 | Smith | 43/43.12 |

*Primary Examiner*—Daniel T. Pihulic

*Attorney, Agent, or Firm*—Weingarten, Schurgin, Gagnebin & Hayes LLP

[57] ABSTRACT

A sound amplification system includes an amplifier and a waterproof microphone. In an exemplary embodiment the microphone includes a transducer within a cavity covered by a resilient waterproof membrane. The system can monitor either the complete frequency range of the microphone or only one or more selected frequency ranges. The system can include one or more noise emitting lures that produce sound in a frequency range corresponding to the one or more selected frequency ranges. The invention also includes a method of waterproofing a miniature microphone. A housing can be provided for the microphone to protect it and to reduce background noise caused by turbulence during towing. The housing has a streamlined shape and can be weighted. One or more fins can be provided to stabilize the housing.

9 Claims, 9 Drawing Sheets

SOUND AMPLIFICATION SYSTEM HAVING A SUBMERSIBLE MICROPHONE

RELATED INVENTIONS

This is a continuation-in-part of U.S. patent application Ser. No. 08/492,412, filed Jun. 19, 1995, now abandoned.

FIELD OF INVENTION

The present invention relates to sound amplification, and more particularly to a sound amplification system having a submersible microphone.

BACKGROUND OF INVENTION

Devices are known for helping sport and commercial fisherman detect fish. One such device is a sonar transducer. Sonar transducers bounce sound waves off the sea bottom for detecting fish and other underwater objects, and provide a graphical output to a sophisticated monitor by use of heavy shielded cables. Fisherman must constantly watch the monitor for signs of underwater activity. This can be a time consuming chore and a distraction from the ultimate goal of catching fish.

Sonar transducers respond to the reflection of sound waves, and therefore must be fixed to the bottom of a ship or boat, or hung from the side of the boat to direct sound waves towards the sea bottom. The transducers along with a pre-amplifier are normally encased within hard rubber or plastic to form a waterproof enclosure, which adds to the size and weight of these devices. Due to the sophistication and complexity of these devices, they need to draw power off of the power supply of a ship or boat. This requires extensive time and labor to outfit a boat for and install these devices. On large boats, mounting of the transducer can require a diver to perform underwater installation or it can require the boat to be hauled out of the water for the work to be accomplished in dry dock.

The monitors associated with sonar transducers can take up large amounts of precious console space, which can be especially troublesome on small boats with limited room. Making room for the monitor is not an easy task; it may involve moving other electronic devices on the boat due to interfering signals, or adding housings to the boat for placement and separation of specific electronics.

Another type of acoustic device for detecting underwater activity is a hydrophone, which is generally no smaller than a fist. These devices are normally used for research expeditions, and are used in highly complex electronic systems. Hydrophones, like sonar transducers use large shielded cables, and are generally encased with a pre-amplifier in hard rubber or plastic to form a waterproof enclosure, which adds to the size and weight of these devices. Due to the size, weight, and cable requirements, hydrophones cannot be cast or attached to a fishing line or lure. They have limited mobility and are usually suspended from the side of a boat.

Hydrophones are also normally associated with sophisticated and expensive power amplifiers that are capable of amplifying specific frequencies and tones for detailed analysis of underwater activity. These power amplifiers are generally large and expensive, requiring tabletop space and use of a ship's power supply. The combination of large hydrophones, heavy cables and large power amplifiers, limits the portability of a hydrophone system. Even though hydrophone systems might be suitable for researchers, oceanographers, or some commercial fisherman, they are totally unsuitable for a sport fisherman.

Sport fisherman could benefit from a lightweight portable device that could help in the detection of underwater activity. A device that allows a fisherman, while fishing, to freely move about a boat or along the shore, bank, or a dock, without requiring constant monitoring of electronic equipment would be particularly advantageous. Small boat owners could additionally benefit from an underwater activity detection system that does not require precious boat space to be consumed. Shoreline or bank fisherman would be especially well served by such a device because there is no underwater listening device of any size, capability, or complexity that is suitable for shore-based applications. But presently no low cost, simple, small, lightweight, low power, easily operated device exits capable of detecting underwater activity of lures and fish, both near and far from a boat or shore.

SUMMARY OF THE INVENTION

The present invention overcomes the above disadvantages by providing a sound amplification system that includes a submersible miniature microphone and a high output amplifier. The amplifier, which can be no larger than a pack of cigarettes, can be easily carried or worn by a fisherman without being an encumbrance. The system allows for monitoring of underwater acoustic activity, such as fish or lure sounds, to increase the situational awareness of the fisherman. The microphone, which is generally much smaller than a lure, can be easily cast while attached to the end of a fishing line along with the lure or placed into the water independently therefrom. A second waterproof microphone can be added to the system for binaural monitoring of underwater activity. The system can further include a noise emitting lure and a frequency selection device that is tunable to the frequency emission range of the lure.

An important feature of the system is the waterproof coating on the microphone which allows it to be submersible while not substantially interfering with its operation. In an exemplary embodiment the coating includes a resilient polymer. A method of waterproofing a microphone is disclosed in which a microphone is dipped in a waterproof substance, retained in the substance for a predetermined time duration, removed from the substance, and dried.

Also disclosed is a system having a housing for a waterproof microphone. The housing has a streamlined shape to reduce background noise caused by turbulence when the microphone is towed through the water. The housing, which also protects the microphone, can be weighted and one or more fins can be provided to stabilize the housing as it is towed.

BRIEF DESCRIPTION OF THE DRAWINGS

The invention will be more fully understood by reference to the following detailed description when considered in conjunction with the accompanying drawings, in which.

DETAILED DESCRIPTION OF THE INVENTION

Figure 1:
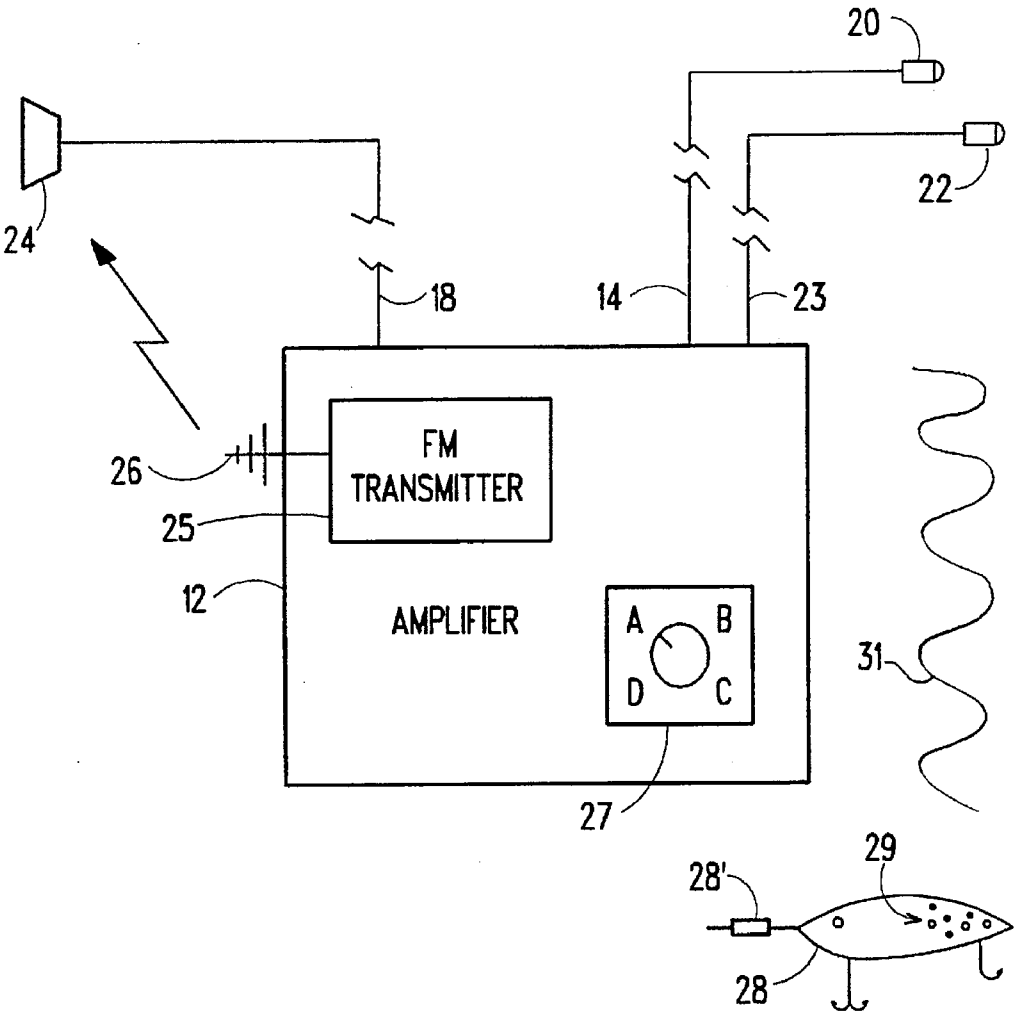
FIG. 1 is a diagram of the sound amplification system having a submersible microphone.

FIG. 1 is an illustration of a sound amplification system in accordance with the present invention. The sound amplification system includes an amplifier 12 having an input 14, and an output 18. The system further includes a submersible microphone 20 in communication with the input 14. A second submersible microphone 22 can be provided for connection to a second input 23 of the amplifier 12. The second input 23 and the second submersible microphone 22, when included as shown in FIG. 1, form a stereophonic embodiment of the present invention described in greater detail with respect to FIGS. 4 and 5.

A speaker 24, such as headphones or an FM headset, can be connected to the output 18 of the amplifier 12 to provide a system for a single user. However, a loudspeaker can be connected to the output 18 of the amplifier 12 to allow multiple users to listen to the detected underwater acoustic activity. In yet another embodiment for single or multiple users, the amplifier is provided with an FM transmitter 25 and an antenna 26 for transmitting the output of the amplifier to a loudspeaker or one or more FM headsets (an FM receiver and one or more speakers). In still another embodiment, the amplifier 12 and headphones can be waterproofed to create a completely submersible system.

The system can include an amplifier 12 having a frequency range selection device 27 that allows the operator to select a predetermined frequency range, represented by letters A-D, that the operator wishes to monitor. The device 27 can be mechanically or electronically actuatable, and can include any number of selectable frequency ranges.

Although the system provides the ability to detect and monitor underwater acoustic activity, the ability to select and monitor a particular frequency range known to be associated with a particular object allows the operator to screen-out potentially distracting or incidental noises. The advantages provided by the frequency range selection device 27 are particularly noticeable when the system further includes a sound emitting lure 28, or a sound emitter 28', that produces sound in a known frequency range that corresponds to a preset frequency range. For example, the system can be provided as a kit including the amplifier 12, speaker 24, microphone 20, and one or more sound emitting lures 28. In an exemplary kit, lures A-D are provided, wherein each of the lures produces a sound corresponding to the preset values of the frequency range selection device 27.

The lure 28 or sound emitter 28' can produce sound either mechanically or electronically. For example, a lure 28 can include a hollow cavity in which one or more small solid objects 29 are loosely retained so that movement of the lure causes the objects to rattle within the cavity to produce a sound. When the lure 28 is manipulated by the fisherman in a particular manner, a cadence can be established producing a readily identifiable sound emission 31 from the lure 28. Even if a gentle fish strike does not interrupt the cadence sufficiently to provide tactile feedback, aspiration of the lure by a fish will cause a noticeable change in the sound emitted by the lure, instantly signaling a strike which would otherwise be undetectable.

Figure 2:
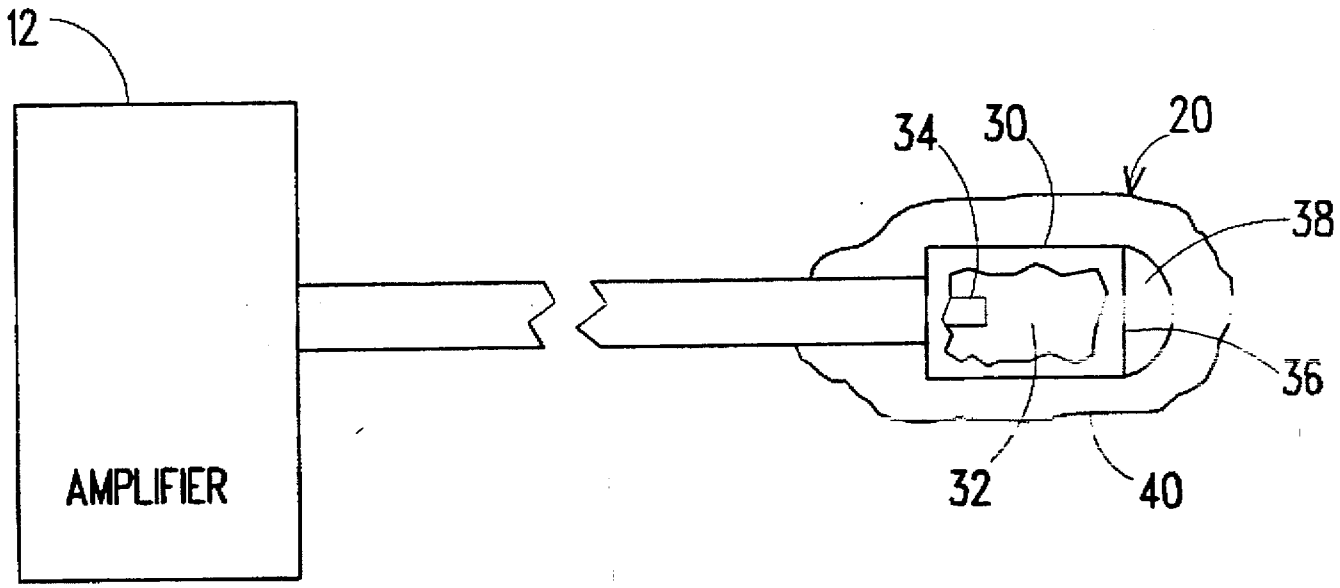
FIG. 2 is a detailed view of the submersible microphone of the system of FIG. 1.

Referring now to FIG. 2, a detailed illustration of the submersible microphone 20 of FIG. 1 is shown. The second submersible microphone 22 can be substantially identical to the first submersible microphone 20, and therefore will not be separately described. The microphone 20 includes a housing 30 having a cavity 32 for a transducer 34 in communication with the amplifier 12. The housing 30 further includes an opening 36 for access to the cavity 32 of the housing 30. The opening 36 of the housing 30 is covered by a sound permeable or acoustically transparent covering 38, such as felt. The entire microphone 20 is coated with a waterproof substance to provide a resilient or flexible membrane 40, shown in exaggerated proportion in FIG. 2, that resonates in response to acoustic activity. Alternatively, the covering 38 alone can be coated with a waterproof substance. The membrane 40 is impervious to water, yet allows underwater vibrations to cause air vibrations inside the housing 30 of the microphone 20 and thereby activate the transducer 34, without substantial interference with the microphone operations. Although the housing 30 is shown as cylindrical in this embodiment, the particular shape of the microphone is unimportant.

In an embodiment of the present invention, the waterproof membrane on the microphone can be formed by a coating process having the following steps. In the first step, an assembled miniature microphone is provided, such as a Panasonic miniature microphone. A subsequent step requires the microphone to be dipped in a waterproof coating substance, such as Color Guard™ Tough Rubber Coating manufactured by Permatex Industrial Corporation of Connecticut. Prior to dipping, the tiny bubbles which could interfere with the sound transmission properties of the membrane can be minimized by agitation or application of a vacuum in a de-bubbling step. When the coating is Color Guard™ Tough Rubber Coating, it must be diluted with a thinner to achieve optimal frequency response. In other words, if the coating is too thick, the sound is deadened. A 1:1 mixture of thinner and coating provides excellent results, however, a mixture range of 3:1 to 1:3 also provides acceptable results.

In an exemplary embodiment, the microphone is dipped into the coating at a downward rate of approximately ½ inch per second. After stopping on the downward stroke, the microphone is retained in the waterproof coating substance for approximately one second. The microphone is removed, in a further step, from the waterproof coating substance at approximately the same rate of speed the microphone was dipped. In a later step, the waterproof coating substance then undergoes a drying process. In the drying process, the microphone is placed with the covering 38 pointing substantially upwards so that the waterproof coating substance is stretched across the covering 38. The covering 38 prevents the waterproof coating substance from entering the cavity 32 of the microphone, while at the same time allowing the coating to form a waterproof membrane 40. The coating is allowed to dry for three or more hours.

Microphones having cords already attached electrically can be dipped as a single unit, so that the cord and microphone interface are covered. Thus, the entire microphone, cords and electrical connections can be sealed into a single waterproof unit. This single waterproof unit can seal the microphone from damaging elements. For example, in salt water, the waterproofing can protect any metal components of the microphone and any wires included with the microphone from being damaged by the effects of galvanic corrosion.

In another embodiment of the invention, the cavity defined by the microphone housing 30 can be pressurized to above one atmosphere. In yet another embodiment the microphone housing 30 can be filled with a fluid, such as oil, to enhance acoustic performance within the cavity. Namely, the fluid inside the housing acts as a superior vibration conductor. The fluid also provides the benefit of eliminating compressive effects related to submersion depth because fluids are substantially incompressible.

Figure 3:
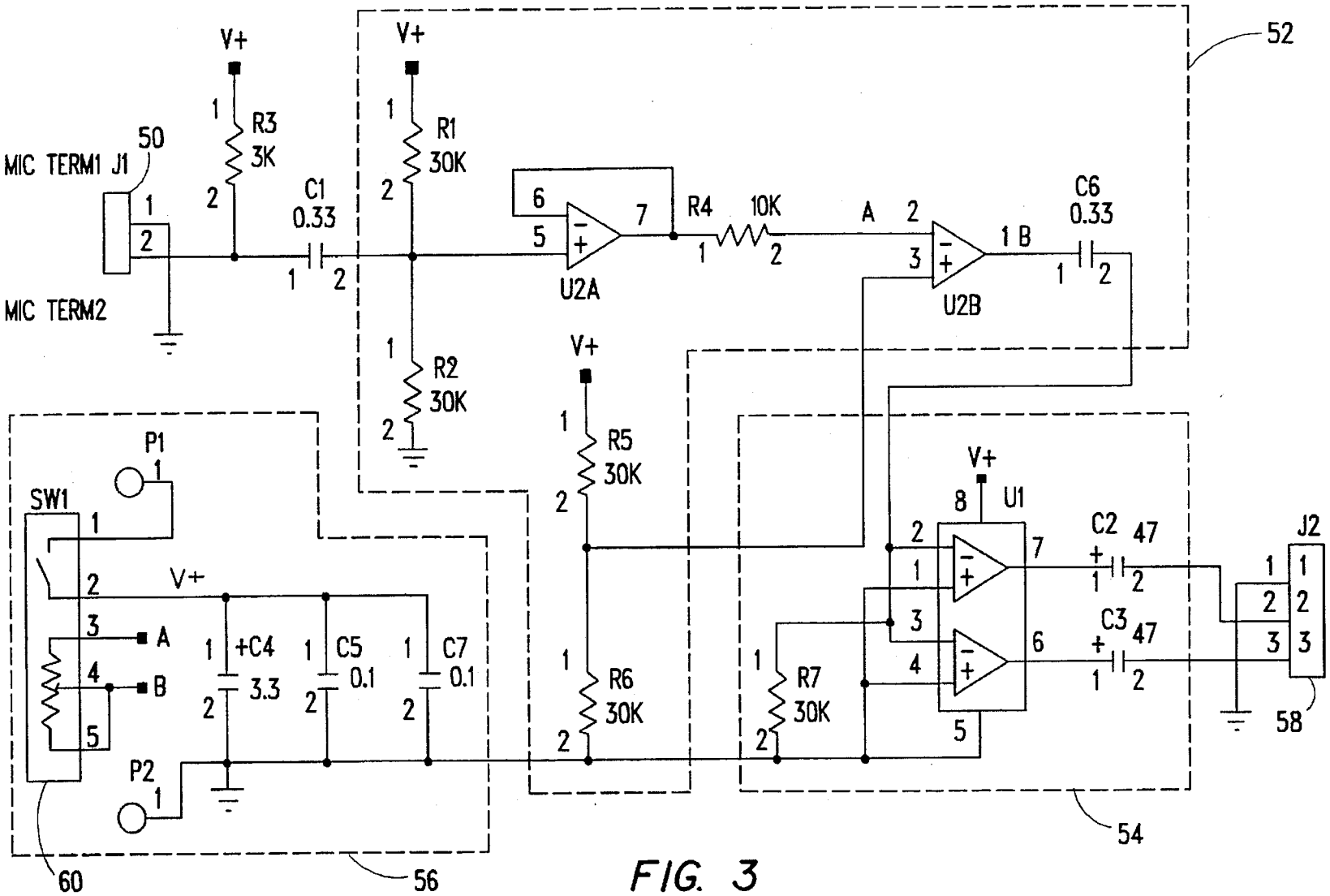
FIG. 3 is a schematic diagram of a monophonic amplifier for the system of FIG. 1.

FIG. 3 is a schematic diagram of a monophonic amplifier specifically adapted for use in the sound amplification system of FIG. 1. The monophonic amplifier has an input 50 capable of receiving a communication signal from the microphone 20, a pre-amplifier 52, a power amplifier 54, a gain control 56, and an output jack 58 for a speaker 24 or headphones. The gain control 56 includes an adjustable switch 60, which is a combination on/off switch and audio tapered potentiometer that adjusts the pre-amplifier gain by a factor of zero to five. The power amplifier 54 enhances the gain of the communication signal by a factor of approximately 1000, which then drives the output jack equipment.

Figure 4:
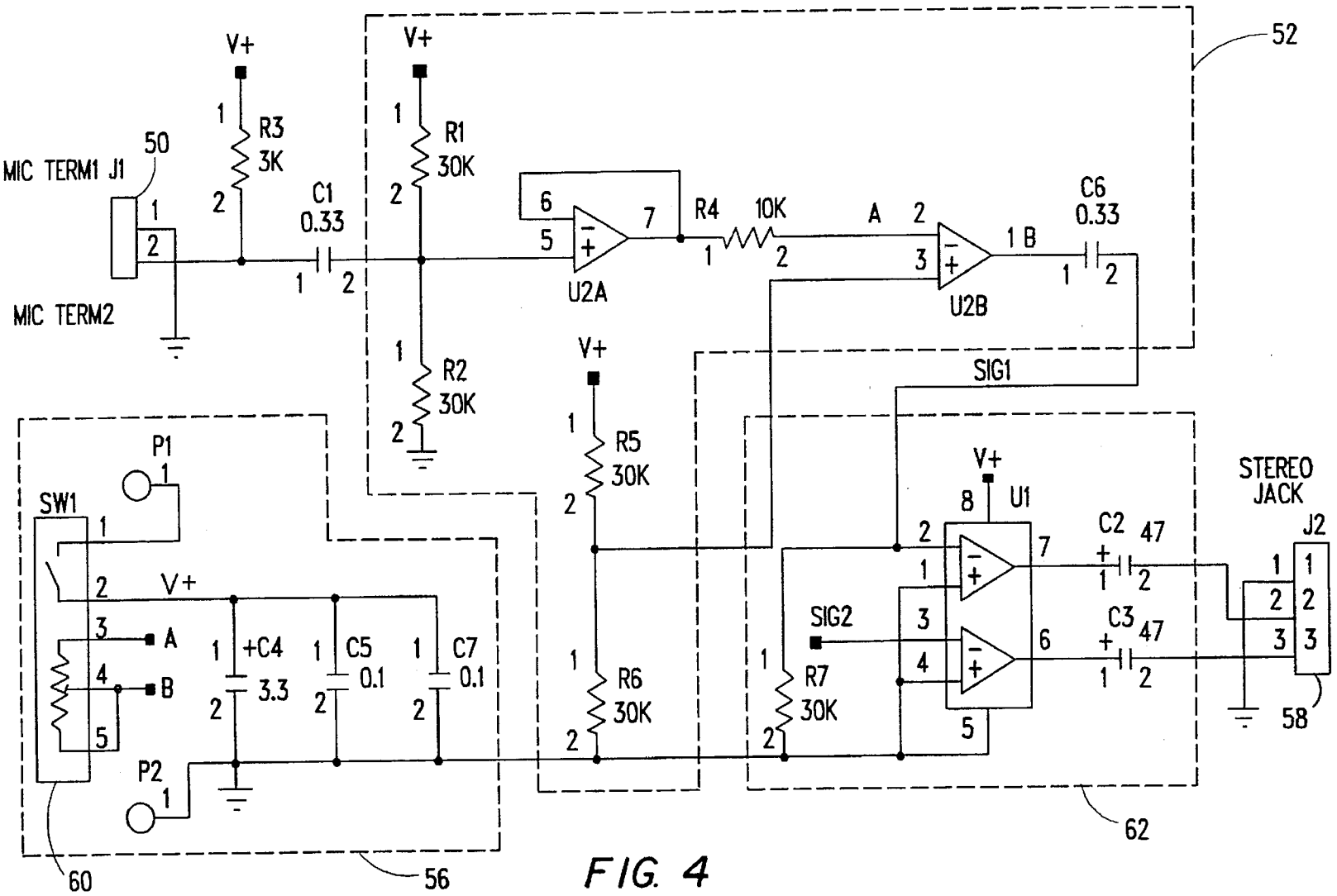
FIG. 4 is a schematic diagram of a portion of a stereophonic amplifier for the system of FIG. 1.
Figure 5:
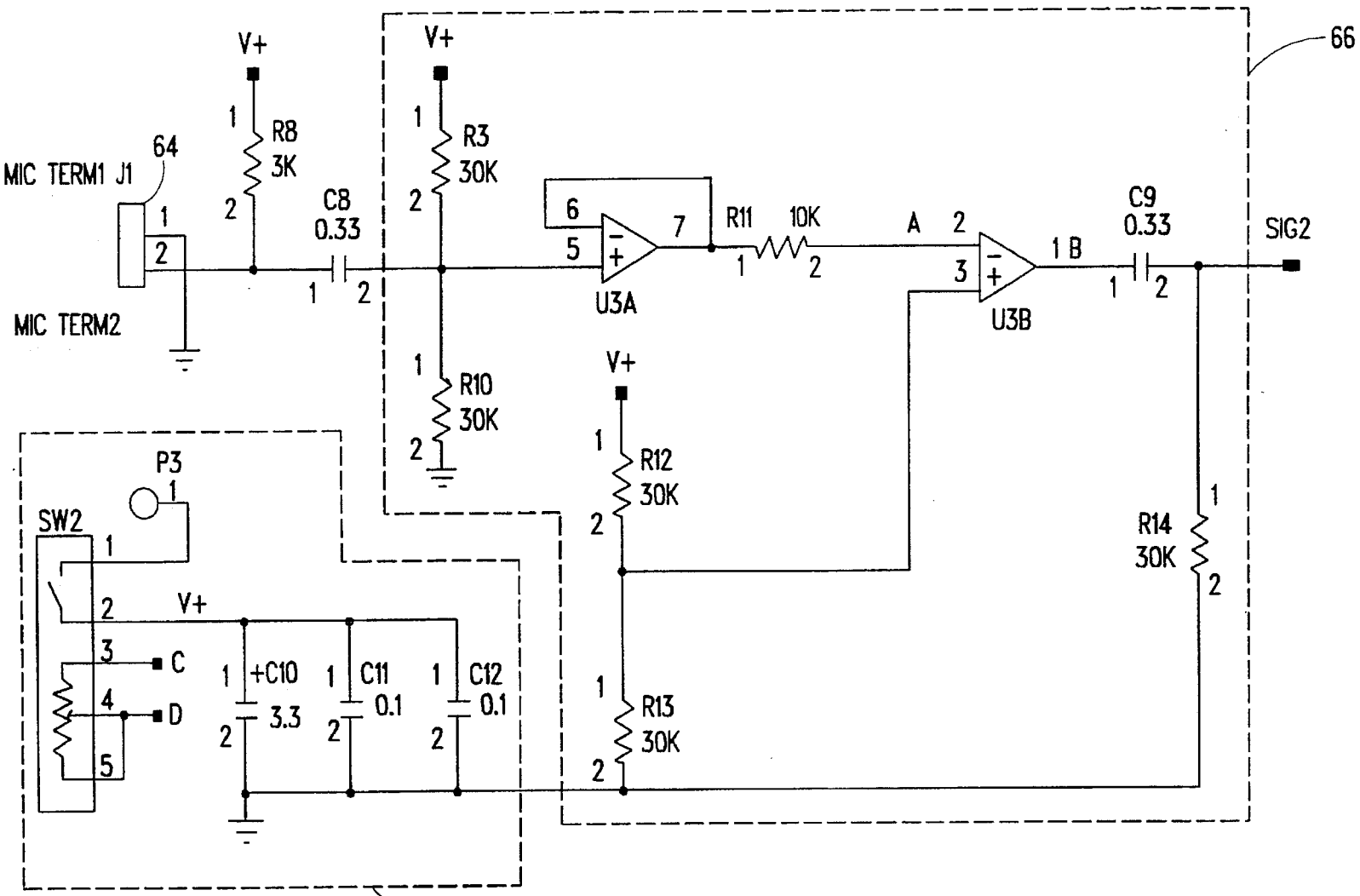
FIG. 5 is a continuation of the schematic diagram of the stereophonic amplifier of FIG. 4.

FIGS. 4 and 5, together, show another embodiment of the amplifier of the present invention. FIG. 4 is a schematic diagram of a stereophonic amplifier for use in the sound amplification system of FIG. 1. The schematic of FIG. 4 is substantially identical to the schematic of FIG. 3, with respect to the input 50, pre-amplifier 52, gain control 56, and output jack 58. FIG. 4 shows a stereophonic power amplifier 62 that receives a signal 1 and a signal 2. Signal 2 is processed via the amplification circuit shown in FIG. 5. FIG. 5 also shows a second input 64, a second pre-amplifier 66, and a second gain control 68, which all operate as discussed above with respect to FIG. 3. The second pre-amplifier 66 outputs the signal 2 to the stereophonic power amplifier 62 of the stereophonic amplifier, as shown in FIG. 4.

Figure 6:
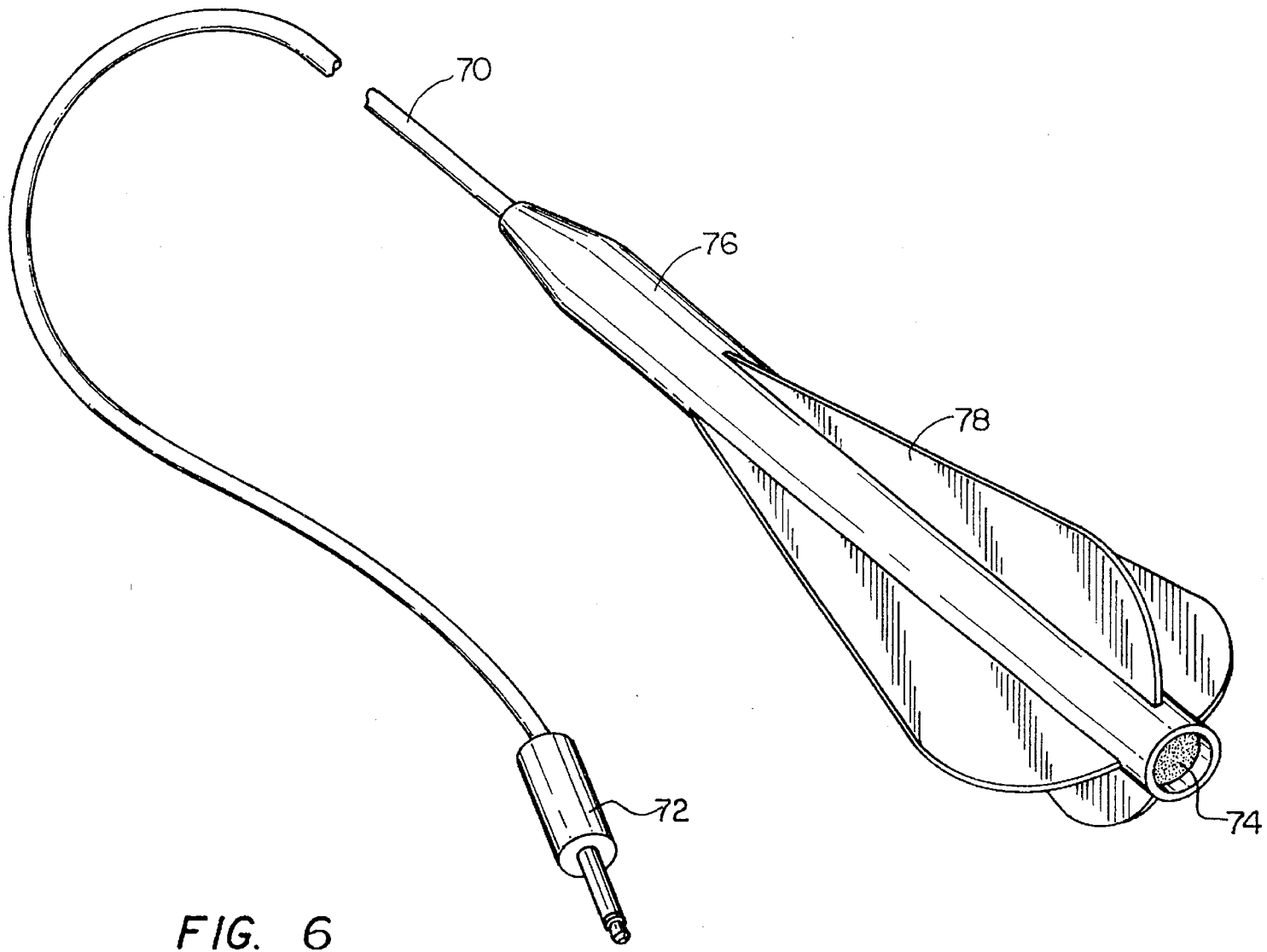
FIG. 6 is a perspective view of a submersible microphone having a streamlined housing.

For certain underwater listening applications it can be desirable to provide a microphone with a housing to protect the microphone and to improve acoustic activity detection. For example, if a microphone is deployed from a moving boat, the sound of water flowing around the microphone can create an unacceptable amount of interference with other activity detectable by the microphone. FIG. 6 illustrates a portion of an underwater detection system comprising a cord 70 having a plug 72 for connection to an amplifier, as shown in FIGS. 1–5, in communication with a microphone 74, wherein a portion of the cord and the microphone are retained within a housing 76.

The housing 76 is provided with a streamlined shape that reduces turbulent water flow past the microphone 74. A non-waterproof microphone can be located within the housing 76, and the housing provided with a waterproof seal, such as by dipping in a sealer as described above. However, FIG. 6 illustrates a waterproof microphone, as described with respect to FIGS. 1–5, which can be exposed to the water through an opening at the rear or trailing end of the housing 76. One or more fins 78 are provided to stabilize the housing 76 as it is pulled through the water to further reduce noise. The fins 78 aid noise reduction by streamlining water flow over the housing 76. Also, the fins 78 quickly reorient and stabilize the device, and the tow direction changes to keep an aft mounted microphone 74 pointed away from a noise producing trolling motor. The housing can be made of plastic or another waterproof material. Although the housing 76 can be rigid, it can also be made of a rubbery or pliable material that is capable of retaining a given shape in use. Very pliable material which can be especially good at sound deadening can be provided with a support frame, if required, to retain a particular shape. Also, the rear opening of the housing can be fitted with a screen across the opening to keep foreign objects beyond a selected size from entering the housing. It should be noted that by allowing the microphone to be in direct contact with water, the device benefits from the superior sound conductance property of water that would be lost were the microphone to be completely encapsulated in a pocket of air.

Figure 7:
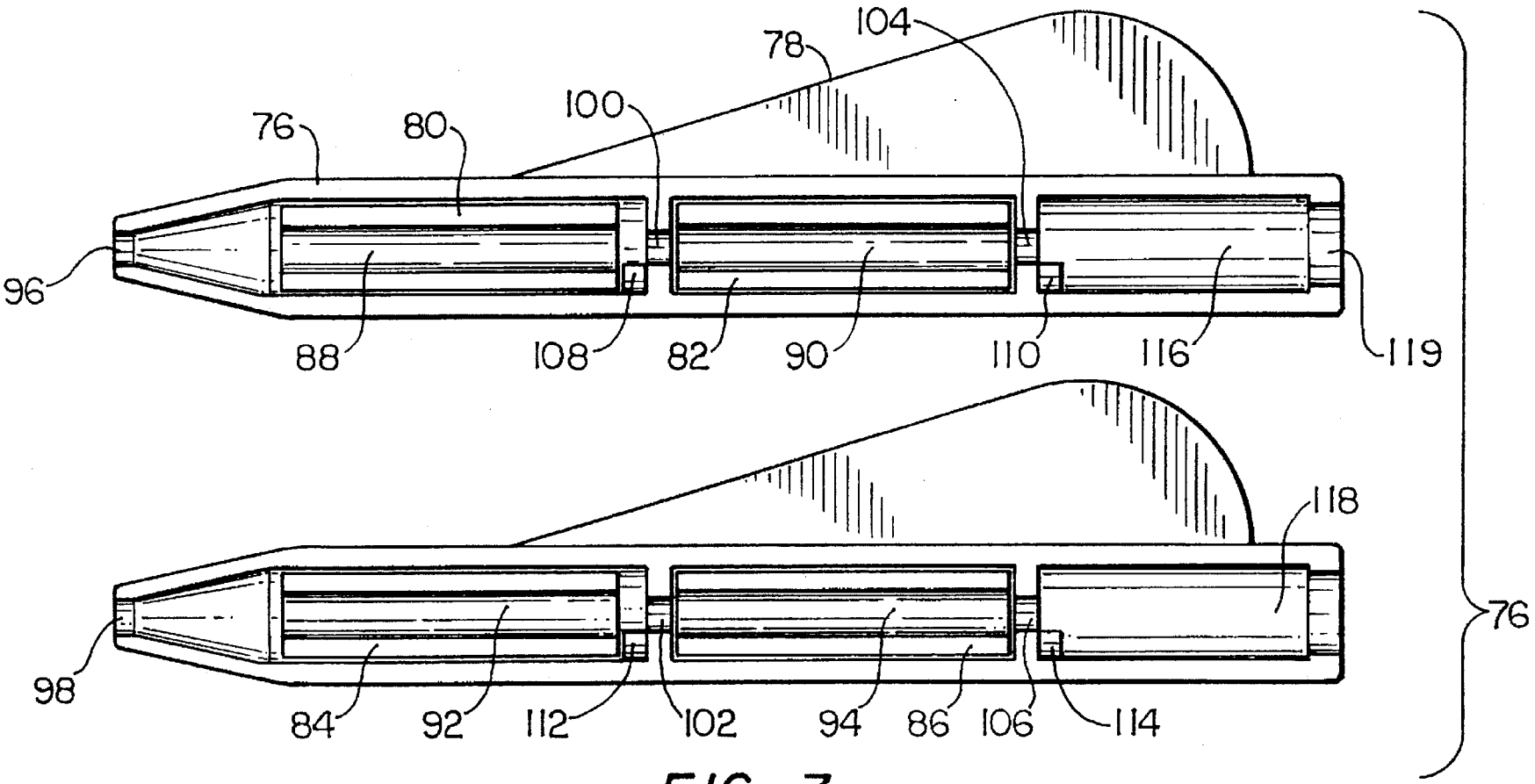
FIG. 7 is a plan view of the interior of an embodiment of the housing having two halves.
Figure 8:
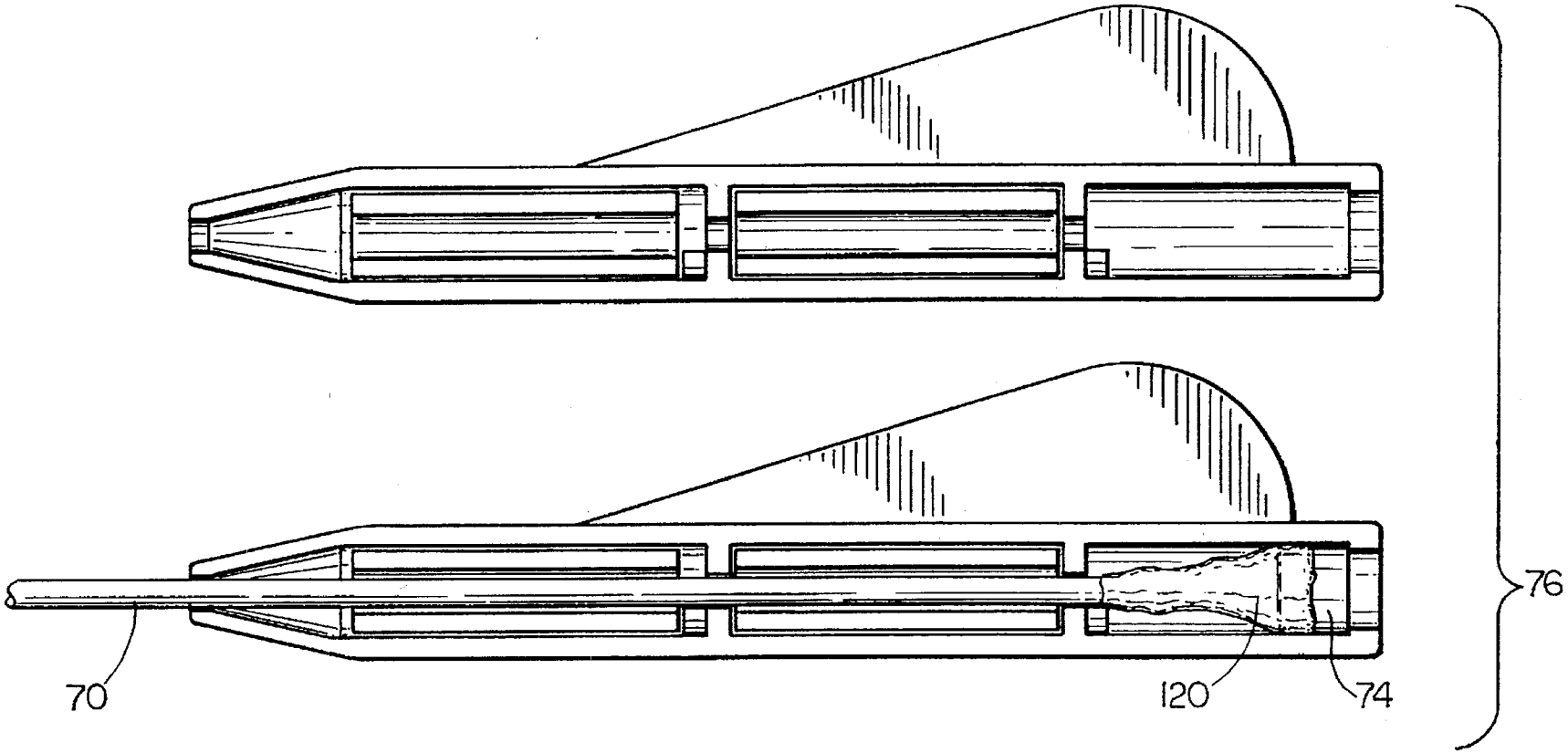
FIG. 8 is a plan view of the housing showing placement of a microphone and cord.

FIG. 7 is an illustration of an embodiment of the housing 76 that includes two substantially identical halves that are about four inches in length. However, other embodiments range from two to eight inches in length. It should be noted that for an embodiment of the housing having identical halves, the cost of manufacture can be substantially reduced. In this embodiment, each of the halves includes two fins 78, wherein one of the fins is visible and the other fin is not as it projects into the drawing page. Each half defines a cavity for receiving the cord 70 and microphone 74 therein, as shown in FIG. 8.

For an embodiment of the housing 76 made of a lightweight plastic, the housing can define additional cavities for retaining weights. In the illustration, four weights 80, 82, 84, and 86 are provided, wherein two weights are associated with each of the halves. Each weight 80, 82, 84, and 86 is shaped to define a channel 88, 90, 92, and 94, respectively, that surrounds a portion of the cord 70 when the two halves are mated. The weights can be friction fitted into the cavities and/or held in place with an adhesive to facilitate assembly. The channels in the weights are substantially aligned with an opening 96, 98 in the nose of each of the respective halves of the housing, and in channels 100, 102, 104, and 106 defined by strengthening ribs in each of the housing halves. In the illustrated embodiment, the weights are lead. However, any dense material is acceptable. Furthermore, although the illustrated location of the weights provides a good weight distribution, other weight shapes and locations are contemplated depending on the weight, length, and overall weight distribution of the housing.

Continuing to refer to FIG. 7, alignment tabs 108, 110, 112, and 114 can be provided to assist alignment of the halves during assembly. Aft of the weight, each housing half defines a cavity 116, 118 for receiving the microphone 74 as shown in FIG. 8. The cavities 116 and 118 are large enough to also accommodate fixative applied to the junction of the cord 70 and the microphone 74. Once the microphone, cord, and weights are installed in the respective halves of the housing, the two haves are joined together by mechanical, thermal, or adhesive material and/or procedures.

Although the rear of the housing includes an opening, the housing can have a ridge 119 that reduces the opening to a diameter smaller than that of the microphone to aid in placement of the microphone during assembly and to inhibit the microphone from sliding out of the rear of the housing during use. It should be noted that the opening at the rear of the housing provides a directional microphone that further shields the microphone from interfering acoustic activity, such as that created by a trolling motor on the towing craft. Although the microphone 74 is shown slightly recessed within the housing 76, it could also be mounted flush with the rear opening or extend slightly therefrom. However, recessing the microphone not only protects it, but it also keeps the microphone in a reduced turbulence zone, yet still in contact with the water.

Figure 9:
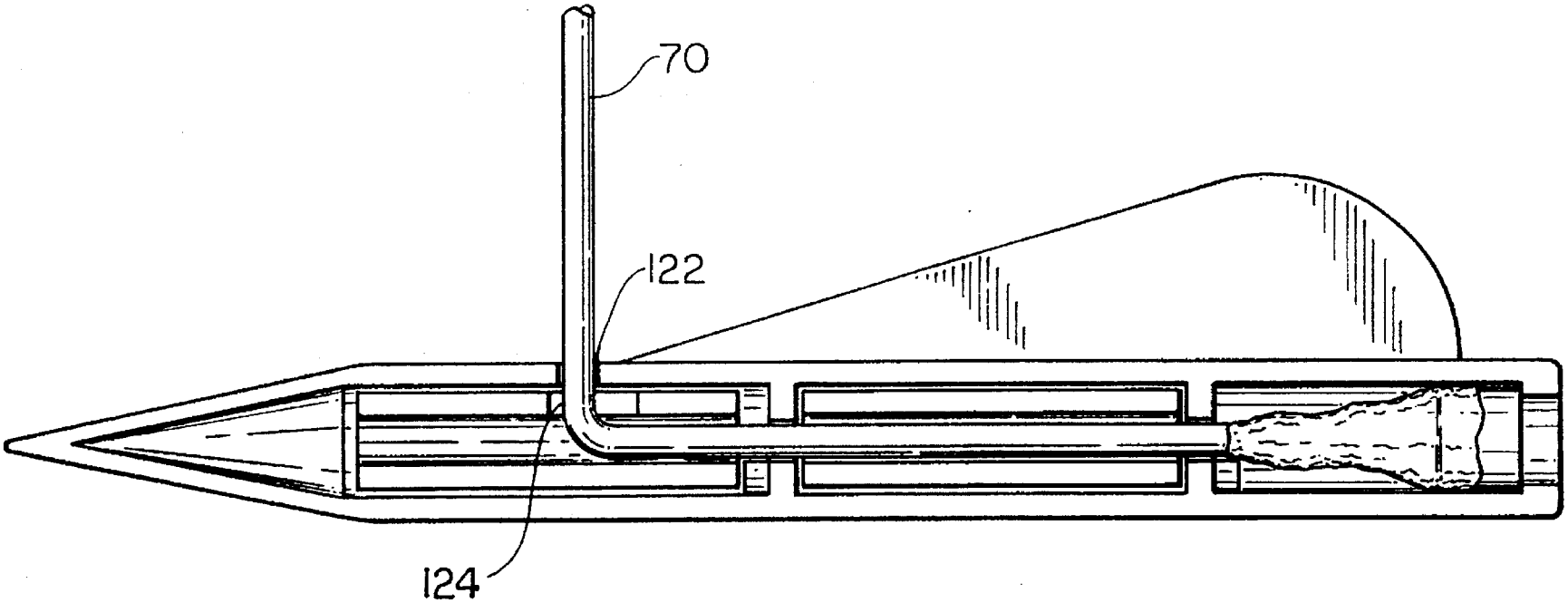
FIG. 9 is a plan view of one half of an alternative embodiment of a housing for a microphone.

FIG. 9 illustrates an alternative embodiment of the housing, wherein an opening 122 is provided along the side of the housing. If the housing is provided with supplemental weights, the weight can include a notch 124 for the cord 70.

In another embodiment of the housing, the housing is a single component and the cord is threaded through a channel within the housing. In yet another embodiment, for either a single or a multi-piece housing, the housing is provided with an integral electrical signal path and plug arrangement, wherein the cord and the microphone plug into the housing and the signal path at different locations.

Although the invention has been shown and described with respect to exemplary embodiments thereof, various other changes, omissions and additions and form in detail thereof, may be made therein without departing from the spirit and scope of the invention.

What is claimed is:

1. A sound amplification system comprising:

a waterproof microphone;

a cord in electrical communication with said waterproof microphone;

a non-flotational housing defining a first cavity for receiving at least a portion of said cord and said waterproof microphone, wherein said housing is elongate and defines a first opening through which said cord passes from the exterior of said housing into said first cavity and a second opening at one end of said housing that provides access to said microphone, and wherein said housing further defines a second cavity for receiving a weight; and a stabilizing fin secured to an exterior portion of said housing.

2. The sound amplification system of claim 1, wherein said housing comprises a first half and a second half, each of said first and second halves defining a channel for guiding said cord through said housing.

3. The sound amplification system of claim 1, wherein said housing further comprises a first end and a second end, each of said first and second ends defining an opening into said housing, and wherein said cord passes into said housing through said opening in said first end and said microphone is proximate said opening in said second end.

4. The sound amplification system of claim 3, wherein said housing further comprises a weight having a channel therethrough, said weight being disposed between said first end and said second end, and said cord passes through said channel.

5. The sound amplification system of claim 1, wherein said housing has a length in the range of two to eight inches.

6. A sound amplification system comprising:

a waterproof microphone;

a cord in electrical communication with said waterproof microphone;

a housing defining a cavity for receiving at least a portion of said cord and said waterproof microphone, said housing having a first end and a second end, each of said first and second ends defining an opening into said housing, said cord passing into said housing through said opening in said first end, and said microphone being proximate said opening in said second end;

a weight having a channel therethrough, said weight being disposed between said first end and said second end of said housing, said cord passing through said channel; and a stabilizing fin secured to an exterior portion of said housing.

7. A sound amplification system comprising:

a waterproof microphone;

a cord in electrical communication with said waterproof microphone;

a housing defining a first cavity for receiving at least a portion of said cord and said waterproof microphone, wherein said housing is elongate and defines a first opening through which said cord passes from the exterior of said housing into said first cavity and a second opening at one end of said housing that provides access to said microphone, and wherein said housing further defines a second cavity for receiving a weight; and a stabilizing fin secured to an exterior portion of said housing.

8. The sound amplification system of claim 7, wherein said housing comprises a first half and a second half, each of said first and second halves defining a channel for guiding said cord through said housing.

9. The sound amplification system of claim 7, wherein said housing further comprises a first end and a second end, each of said first and second ends defining an opening into said housing, wherein said cord passes into said housing through said opening in said first end and said microphone is proximate said opening in said second end, and wherein said housing further comprises a weight having a channel therethrough, said weight being disposed between said first end and said second end, and said cord passes through said channel.

* * * * *